US010654684B2

(12) United States Patent
Kronkvist et al.

(10) Patent No.: US 10,654,684 B2
(45) Date of Patent: May 19, 2020

(54) ELEVATOR SYSTEM CONFIGURED TO ESTIMATE A TIME ASSOCIATED WITH CLOSING DOORS OF AN ALLOCATED ELEVATOR AND METHOD OF PERFORMING SAME

(71) Applicants: Kenneth Kronkvist, Vantaa (FI); Pasi Raitola, Hyvinkaa (FI)

(72) Inventors: Kenneth Kronkvist, Vantaa (FI); Pasi Raitola, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/134,932

(22) Filed: Apr. 21, 2016

(65) Prior Publication Data

US 2016/0251199 A1 Sep. 1, 2016

Related U.S. Application Data

(63) Continuation of application No. PCT/FI2014/050839, filed on Nov. 6, 2014.

(30) Foreign Application Priority Data

Nov. 19, 2013 (FI) ..... 20136147

(51) Int. Cl.
*B66B 13/02* (2006.01)
*B66B 1/46* (2006.01)

(52) U.S. Cl.
CPC ..... *B66B 1/468* (2013.01); *B66B 2201/00* (2013.01); *B66B 2201/211* (2013.01); *B66B 2201/232* (2013.01); *B66B 2201/4653* (2013.01)

(58) Field of Classification Search
USPC ..... 187/381
See application file for complete search history.

(56) References Cited

U.S. PATENT DOCUMENTS 3,682,275 A * 8/1972 Loshbough ..... B66B 5/02 187/387
4,030,571 A * 6/1977 Kaneko ..... B66B 1/2458 187/387

(Continued)

FOREIGN PATENT DOCUMENTS

WO WO-2006097568 A1 9/2006
WO WO-2006114877 A1 11/2006

(Continued)

OTHER PUBLICATIONS

International Search Report PCT/ISA/210 for International Application No. PCT/FI2014/050839 dated Feb. 11, 2015.

(Continued)

*Primary Examiner* — Christopher Uhlir
(74) *Attorney, Agent, or Firm* — Harness, Dickey and Pierce, P.L.C.

(57) ABSTRACT

The present invention discloses a method and an elevator system, in which a passenger gives elevator calls with a personal terminal device. An elevator car is allocated to the passenger on the basis of an elevator call, the maximum time from the moment of giving the call to the moment the doors of the allocated elevator car will close on the call-giving floor is calculated. The aforementioned maximum time is sent to the terminal device of the passenger for being presented to the passenger on the terminal device.

9 Claims, 1 Drawing Sheet

(56) References Cited

U.S. PATENT DOCUMENTS 4,852,696 A * 8/1989 Fukuda ..... B66B 3/00 187/392
5,952,626 A * 9/1999 Zaharia ..... B66B 1/468 187/381
7,032,716 B2 * 4/2006 Meyle ..... B66B 1/2458 187/249
7,610,995 B2 11/2009 Ylinen et al.
7,918,321 B2 * 4/2011 Sakurai ..... B66B 1/2458 187/382
7,921,968 B2 * 4/2011 Stanley ..... B66B 1/20 187/383
8,028,809 B2 * 10/2011 Blackaby ..... B66B 1/34 187/382
8,151,943 B2 4/2012 de Groot
8,397,874 B2 * 3/2013 de Groot ..... B66B 1/2458 187/382
8,439,169 B2 * 5/2013 Iio ..... B66B 1/2458 187/387
9,469,500 B2 * 10/2016 Friedli ..... B66B 1/2408
2002/0063632 A1 5/2002 Bowman et al.
2008/0067013 A1 3/2008 Ylinen et al.
2009/0050417 A1 2/2009 de Groot
2012/0097488 A1 * 4/2012 Taiana ..... B66B 1/468 187/395
2012/0160612 A1 6/2012 de Groot
2012/0181115 A1 * 7/2012 Koba ..... B66B 1/468 187/247
2013/0153339 A1 * 6/2013 Sarjanen ..... B66B 1/468 187/382

FOREIGN PATENT DOCUMENTS

WO WO-2009024853 A1 2/2009
WO WO-2009130364 A1 10/2009

OTHER PUBLICATIONS

Written Opinion of the International Searching Authority PCT/ISA/237 for International Application No. PCT/FI2014/050839 dated Feb. 11, 2015.
Finish Search Report Application No. 20136147 dated Apr. 23, 2014.

* cited by examiner

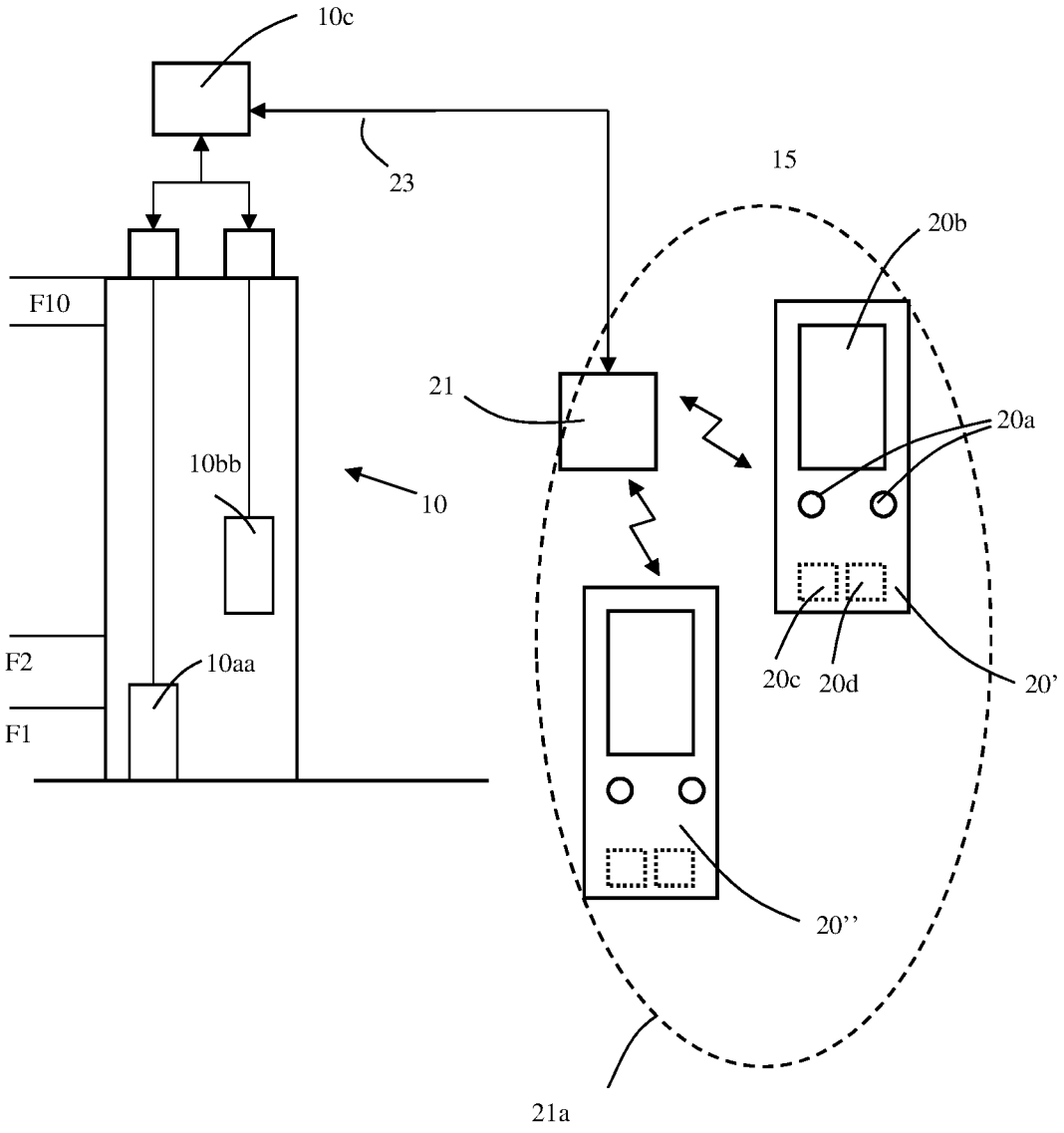
10c
23
15
20b
F10
21
20a
10bb
10
F2
10aa
20c
20d
20'
F1
20''
21a

ELEVATOR SYSTEM CONFIGURED TO ESTIMATE A TIME ASSOCIATED WITH CLOSING DOORS OF AN ALLOCATED ELEVATOR AND METHOD OF PERFORMING SAME

This application is a continuation of PCT International Application No. PCT/FI2014/050839 which has an International filing date of Nov. 6, 2014, and which claims priority to Finnish patent application number 20136147 filed Nov. 19, 2013, the entire contents of both of which are incorporated herein by reference.

FIELD OF THE INVENTION

The invention relates to elevator systems. More particularly the invention relates to control commands of an elevator system to be given with a personal terminal device.

BACKGROUND OF THE INVENTION

Concerning elevator systems, a call-giving method is known wherein a passenger gives calls to an elevator system by means of a personal terminal device. This generally takes place already before going into the elevator car, e.g. in the elevator lobby. A terminal device can be a mobile phone or a means of communication comparable to it, by the aid of which a passenger can send a call wirelessly to the elevator system. When using a terminal devices, call-giving is generally based on so-called destination calls, in which case each passenger must be give with his/her terminal device a call to the floor to which he/she is traveling. On the basis of the call the elevator system allocates to the passenger an elevator car, using which he/she will get to his/her desired floor. The allocation takes place immediately in connection with the call-giving, after which the elevator system sends information about the allocated elevator car to the terminal device of the passenger. When the allocated elevator car arrives at the departure floor of the passenger (the call-giving floor), the doors of the elevator car open to let passengers into the elevator car. The open time (door time) is limited in such a way that the set maximum door time is not exceeded, so that the transport capacity of the elevator system can be maintained as optimal. There can also be sensors in connection with the elevator car and/or a door, from the signals of which sensors the elevator system can deduce whether passengers are coming/have come into the elevator car and/or are leaving/have left it. If, on the basis of the signals given by the sensors, no passengers are entering/leaving, the door of the elevator car can close and the elevator car can start moving.

When a passenger uses a personal terminal device for giving calls, the distance from the call-giving location to the elevators/elevator lobby can be very long indeed and the passenger does not have time within the scope of the aforementioned maximum door time to get into the elevator car serving him/her. In this case the doors of the elevator car close before the arrival in the elevator car of the passenger and the elevator car leaves the call-giving floor, serving other passengers that are already in the elevator car. To obtain elevator service, the passenger must therefore give his/her elevator call again, which of course hampers and delays the arrival of the passenger at his/her destination. On the other hand, the maximum door time cannot be unreasonably lengthened because passengers in the elevator car could experience uncertainty and confusion while waiting for the doors of the elevator car to close.

AIM OF THE INVENTION

The aim of the present invention is to disclose a solution, which eliminates or at least alleviates the drawbacks occurring in prior-art solutions presented above.

SUMMARY OF THE INVENTION

The method according to the invention is characterized by what is disclosed in the characterization part of claim 1. The elevator system according to the invention is characterized by what is presented in the characterization part of claim 10. Other embodiments of the invention are characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for giving elevator calls with a personal terminal device to an elevator system, which comprises at least one elevator. According to the invention an elevator call given by a passenger with his/her terminal device is registered, an elevator car is allocated to the passenger on the basis of the aforementioned elevator call, the maximum time from the moment of giving the call to the moment the doors of the allocated elevator car will close on the call-giving floor is calculated, and the aforementioned maximum time is transmitted to the terminal device of the passenger for being presented to the passenger.

The terminal device can be e.g. a mobile phone or other personal call-giving device having a user interface for giving elevator calls and/or other commands of an elevator system as well as for presenting information relating to the elevator system. When a passenger gives an elevator call from his/her terminal device from outside the elevator car, the elevator call is transmitted wirelessly from the terminal device to the elevator system. The elevator system allocates an elevator car serving the passenger and estimates how long the journey to call-giving floor will take with the allocated elevator car, and how long at maximum the doors of the elevator car will be open on the call-giving floor. The calculated time estimate (maximum time) is transmitted via a wireless data transfer connection to the terminal device, where the passenger is informed of the maximum time. The information to be presented is e.g. a time counter to be shown on the display of the terminal device, which time counter indicates how much time the passenger has, at each inspection moment, to get into the allocated elevator car before the doors of the elevator car close. The elevator call given by a passenger with his/her terminal device can be any call whatsoever, such as a destination call or a conventional up/down call.

In one embodiment of the invention the aforementioned maximum time is updated and transmitted to a terminal device for being presented to the passenger. The maximum time can change e.g. because the allocated elevator car stops at some floor on its route for a longer/shorter time than what the elevator system earlier estimated. As a result of the embodiment, the passenger continuously receives up-to-date information on how much time he/she has to get into the elevator car serving him/her.

In one embodiment of the invention a passenger shortens and/or lengthens the maximum door time used by the allocated elevator car on the call-giving floor, and simultaneously the maximum time remaining. The user interface of a terminal device has e.g. one or more pushbuttons, by means of which a passenger can lengthen/shorten the maximum time within which the scope of which the passenger must get into the elevator car. As a result of the embodiment, a passenger can e.g. lengthen the maximum time if it is obvious that he/she would not otherwise get into the allocated elevator car in time.

In one embodiment of the invention a passenger can cancel an elevator call given by him/her, and simultaneously the allocation of an elevator car connected to it, from his/her terminal device. As a result of the embodiment, a passenger can change his/her travel plan without loading the elevator system with unnecessary elevator calls In one embodiment of the invention a passenger can also give from his/her terminal device a re-allocation command, in which case a new elevator car is allocated to the elevator call given by the passenger and the previous allocation is simultaneously cancelled. As a result of the embodiment, a passenger does not need to hurry unnecessarily into the allocated elevator car, but instead he/she can reserve for himself/herself elevator transportation following the original elevator transportation.

In one embodiment of the invention a passenger can give from his/her terminal device a door-reopen command, if the door is closing or has closed but the elevator car has not left the call-giving floor. As a result of the embodiment, collisions into the doors of the elevator car decrease because the doors can be reopened from a safe distance.

In one embodiment of the invention an estimate of the travel time of a passenger to an elevator car being allocated and/or to an elevator lobby is connected to the call information. The location in the building of the terminal device of the passenger is determined and a travel time forecast is calculated on the basis of it. As a result of the embodiment, the elevator system can take into account in the allocating the travel time estimate of a passenger e.g. in such a way that the elevator car being allocated arrives at essentially the same time at the call-giving floor as the passenger arrives at the allocated elevator.

The present invention also discloses an elevator system, which comprises at least one elevator, a control system, one or more personal terminal devices, means for wirelessly transmitting information between a terminal device and the elevator system. According to the invention the control system is arranged, to register an elevator call given by a passenger with his/her terminal device, to allocate an elevator car to the passenger on the basis of the aforementioned elevator call, to calculate a time estimate for the maximum time from the moment of giving the call to the moment the doors of the allocated elevator car will close, and to send information about the aforementioned maximum time to a terminal device of a passenger, which terminal device has means for presenting the aforementioned maximum time to the passenger.

With the solution according to the invention numerous advantages are achieved compared to prior-art solutions. Passengers receive up-to-date information on how much time they have to get to the elevators, and can therefore adapt their arrival at the elevator lobby better than before and without unnecessary rushing. Passengers can lengthen the maximum door time as needed, in which case late arrivals of passengers for elevator services decrease, and at the same time the transport capacity of the elevator system remains optimal. As a result of the invention passengers can give their calls at a very long distance from the elevators, e.g. immediately they enter the building, in which case the elevator system can better optimize its operation for the elevator calls of passengers.

LIST OF FIGURES

In the following, the invention will be described in detail by the aid of examples of its embodiments, wherein:

FIG. 1 presents one elevator system according to the invention.

DETAILED DESCRIPTION OF THE INVENTION

FIG. 1 presents an elevator system 10 according to the invention. The elevator system 10 forms an elevator group, which comprises two elevators 10*a*, 10*b*, the elevator cars 10*aa*, 10*bb* of which move in the elevator hoistway between the floors F1, F2 . . . F10. The group control 10*c* controls the elevators of the elevator group on the basis of elevator calls given by passengers. Each passenger has a personal terminal device 20 (20', 20"), e.g. a mobile phone, for giving elevator calls to the elevator system 10. The terminal device 20 has a plurality of pushbuttons 20*a* for giving elevator calls, e.g. destination calls. The terminal device further comprises a display 20*b*, on which can be presented information relating to the giving of a call, such as information about the elevator car allocated to a passenger. The terminal device 20 communicates wirelessly with the control system of the elevator system via the base station 21. The data transfer connection between a terminal device and a base station is e.g. a Bluetooth connection, a WLAN connection or some other data transfer connection suited to the purpose. The terminal device 20 is provided with software for giving elevator calls and other commands related to the elevator system as well as for receiving information related to these and for displaying said information on a display 20*b* to a passenger. By means of the pushbuttons 20*c*, 20*d* a passenger can shorten/lengthen the maximum time e.g. in steps of 20 seconds.

When a passenger arrives in the entrance lobby of a building, he/she can send with his/her terminal device an elevator call to the elevator system 10. The passenger gives the elevator call either manually with the pushbuttons 20*a* or the elevator system generates an elevator call automatically when the base station detects the terminal device 20 of the passenger. The elevator system allocates to the passenger an elevator car on the basis of the desired optimization criteria. After the allocation, the elevator system calculates a forecast for the run time of the aforementioned elevator car to the call-giving floor and sends information about the allocated elevator car and about the maximum time to the terminal device of the passenger, which maximum time is the aforementioned run time plus the maximum door time of the allocated elevator car. The terminal device receives the information about the allocated elevator car and about the maximum time and displays it on the display 20*b* of the terminal device, e.g. "Elevator B, maximum time 50 s". After this the terminal device calculates the remaining maximum time in real-time and updates it on the display

20*b*. In this example, the elevator car B has been allocated to the passenger, into which the passenger must get within 50 seconds because after this the doors of the elevator car will close and the elevator car will drive to the next stopping floor. If the passenger notices on the basis of the maximum time remaining, maximum time e.g. 10 seconds, that he/she will not get into the allocated elevator car in time, he/she can send to the elevator system 10 with his/her terminal device a request to lengthen the maximum time by pressing e.g. the pushbutton 20*d*. If the elevator system accepts the request to lengthen the maximum time, answering e.g. 20 seconds per press of pushbutton 20, the elevator system sends a new maximum time to the terminal device. Owing to the new maximum time, the waiting time of the elevator car on the call-giving floor lengthens according to the example to 30 seconds (10 seconds+20 seconds), in which case the passenger has 20 seconds more time in which to get into the elevator car. So that passengers could not lengthen the maximum time unlimitedly, a limit value for the maximum door time is set in the elevator system, which limit value cannot be exceeded with lengthening requests. The elevator system rejects a lengthening request when as a consequence of one or more consecutive lengthening requests the aforementioned limit value for a certain elevator car would be exceeded. If a number of passengers on the same call-giving floor are allocated to the same elevator car, they can of course generate the aforementioned lengthening requests independently of each other. In this case each change to the maximum time is updated for all the aforementioned passengers (on the terminal device of the passengers) in real-time.

It is possible that an allocated elevator car stops on its journey at another floor preceding the call-giving floor, where the stop lasts longer than forecast if e.g. the departure of passengers from the elevator car on the aforementioned other floor is slower than forecast. In this case the elevator system can automatically calculate a new maximum time for the passenger that the elevator car is serving and send the new maximum time to the terminal device of the passenger for presenting on the display 20*b*. On the basis of the updated maximum time, a passenger can adapt his/her arrival time at the elevators better.

As stated above, the elevator system either accepts or rejects a request to lengthen the maximum time made by a passenger. The elevator system can reject a lengthening request also because the average waiting time of passengers, travel time of passengers, filling degree of the elevator cars or some other traffic situation of the elevator system and/or a variable indicating congestion or a combination of these exceeds a given limit value. As a result of the embodiment, the transport capacity of the elevator system can be maintained as optimal without restricting the number of lengthening requests. The elevator system can also automatically allocate to a passenger a new elevator car if the lengthening request given by him/her would cause the limit value given for the given maximum door time to be exceeded. The elevator system transmits to the terminal device information about the newly allocated elevator car and the maximum time relating to it.

Since a lengthened maximum time can cause uncertainty in the passengers already in the elevator car, information means are installed in elevator cars, e.g. display means (not in FIG. 1) with which information relating to the maximum time can be given to the passengers, e.g. by showing the remaining maximum time, which the control system of the elevator system updates in real-time.

According to one embodiment of the invention a passenger can cancel an elevator call he/she has given from the user interface of a terminal device, e.g. by simultaneously pressing pushbuttons 20*c*, 20*d*. A passenger can also his/her elevator call again, in which case a new elevator car is allocated to the passenger (re-allocation of call command) and the previous allocation is simultaneously cancelled.

According to one embodiment of the invention a passenger can give from his/her terminal device a door-reopen command, if the door is closing or has closed but the elevator car has not yet left the call-giving floor. A reopening command is sent from a terminal device to the elevator system e.g. when the maximum time has reached the value 0 and the passenger presses e.g. the pushbutton 20*d* of the terminal device.

According to one embodiment of the invention an estimate of the travel time of a passenger to the elevators, or information determining it, is connected to the call data of an elevator call sent by a terminal device to the elevator system. The travel time is determined e.g. by locating the terminal device of the passenger in the building at the time of giving the call using indoor locating methods that are per se known in the art, e.g. by means of one or more base stations 21. On the basis of the location data and the presumed travel speed of the passenger, the travel time of the passenger to the elevators can be calculated and can be connected to the call data. The elevator system can use the travel time estimate e.g. in such a way that the arrival in the elevator lobby of the passenger and of the elevator car being allocated are as far as possible matched to occur at essentially the same time.

The invention is not limited only to be applied to the embodiments described above, but instead many variations are possible within the scope of the inventive concept defined by the claims below.

The invention claimed is:

1. A method for controlling an elevator system, the elevator system including at least one elevator, and the method comprising:

receiving an elevator call from a first terminal device of a plurality of terminal devices, the first terminal device being a portable terminal device carried by a passenger;

estimating a passenger arrival time for the passenger associated with the first terminal device to arrive at one or more of an elevator car and an elevator lobby based on a location of the first terminal device relative to the elevator lobby;

allocating an elevator car based on the passenger arrival time in an attempt to match the passenger arrival time and an elevator arrival time of the elevator car to the elevator lobby, the allocated elevator car having a default door open time in which doors of the elevator car remain in an open state;

calculating a call specific estimated closing time of a closing of the doors of the allocated elevator car based on the elevator arrival time for the allocated elevator car to arrive at a floor associated with the elevator call and the default door open time, the call specific estimated closing time being particular to the elevator call;

transmitting the call specific estimated closing time to the first terminal device;

updating the call specific estimated closing time based on at least a duration associated with executing elevator calls associated with floors preceding the floor associated with the elevator call after transmitting the call specific estimated closing time;

transmitting the updated call specific estimated closing time to the first terminal device;

receiving a request to increase the call specific estimated closing time from the passenger via the first terminal device prior to arrival of the passenger to the elevator lobby; and selectively increasing the updated call specific estimated closing time by selectively lengthening the time in which doors of the elevator car remain in the open state in response to the request from the first terminal device such that upon arrival of the allocated elevator car to the elevator lobby the doors of the allocated elevator car remain open longer than the default door open time, based on a limit value corresponding to the call specific estimated closing time not being exceeded.

2. The method according to claim 1, further comprising:

receiving a request to cancel the elevator call from the first terminal device; and deallocating of the elevator car associated with elevator call.

3. The method according to claim 1, further comprising:

receiving a request to reopen the doors of the elevator car from the first terminal device.

4. The method according to claim 1, further comprising:

receiving a request to reallocate the elevator call to a different elevator car from the first terminal device;

deallocating the elevator car associated with the elevator call; and allocating a new elevator car based on the request to reallocate.

5. The method according to claim 3, further comprising:

determining whether to accept the request to reopen the doors of the elevator car based on whether the elevator car has left; and accepting the request to reopen the doors of the elevator car from the first terminal device if the determining determines to accept the request.

6. An elevator system, comprising:

a control system configured to, receive an elevator call sent by a first terminal device among a plurality of terminal devices, the first terminal device being a portable terminal device carried by a passenger, estimate a passenger arrival time for the passenger associated with the first terminal device to arrive at one or more of an elevator car and an elevator lobby based on a location of the first terminal device relative to the elevator lobby, allocate an elevator car based on the passenger arrival time in an attempt to match the passenger arrival time and an elevator arrival time of the elevator car to the elevator lobby, the allocated elevator car having a default door open time in which doors of the elevator car remain in an open state, calculating a call specific estimated closing time of closing of the doors of the allocated elevator car based on the elevator arrival time for the allocated elevator car to arrive at a floor associated with the elevator call and the default door open time, the call specific estimated closing time being particular to the elevator call, transmit the call specific estimated closing time to the first terminal device, update the call specific estimated closing time based on at least a duration associated with executing elevator calls associated with floors preceding the floor associated with the elevator call after transmitting the call specific estimated closing time, and transmit the updated call specific estimated closing time to the first terminal device, receive a request to increase the call specific estimated closing time from the passenger via the first terminal device prior to arrival of the passenger to the elevator lobby, and selectively increasing the updated call specific estimated closing time by lengthening the time in which doors of the elevator car remain in the open state in response to the request from the first terminal device such that upon arrival of the allocated elevator car to the elevator lobby the doors of the allocated elevator car remain open longer than the default door open time, based on a limit value corresponding to the call specific estimated closing time not being exceeded.

7. The elevator system according to claim 6, further comprising:

a display associated with the first terminal device, the display configured to display the time associated with the call specific estimated closing time.

8. The method according to claim 1, further comprising:

determining whether to increase the call specific estimated closing time in response to the request to increase the call specific estimated closing time from the first terminal device.

9. The method according to claim 1, wherein the first terminal device is configured to display information related to the call specific estimated closing time on a display associated therewith.

* * * * *